US006390360B1

(12) United States Patent
Wallace

(10) Patent No.: US 6,390,360 B1
(45) Date of Patent: May 21, 2002

(54) COIN DISPENSER

(75) Inventor: David W. Wallace, Dunfermline (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/585,066

(22) Filed: Jun. 1, 2000

(30) Foreign Application Priority Data

Jun. 2, 1999 (GB) ..... 9912696

(51) Int. Cl.[7] ..... B65D 91/00

(52) U.S. Cl. ..... 232/43.1; 232/44; 232/55; 141/351

(58) Field of Search ..... 232/43.1, 43.4, 232/44, 15, 16, 55, 57, 58, 57.5; 194/344, 202; 193/DIG. 1; 220/916, 86.1; 453/16, 17; 222/52, 56; 221/175, 176, 174; 141/335, 336, 351

(56) References Cited

U.S. PATENT DOCUMENTS 3,680,566 A * 8/1972 Tanaka et al. ..... 453/17
3,807,627 A * 4/1974 Nitschneider ..... 232/15
3,971,393 A * 7/1976 Akai et al. ..... 453/17
4,163,517 A * 8/1979 Kappler et al. ..... 220/916
4,436,102 A * 3/1984 Kokubo et al. ..... 453/17
4,484,592 A * 11/1984 Burnside ..... 453/17
4,529,119 A 7/1985 Granzow et al.
5,366,407 A * 11/1994 Sentoku ..... 453/17
5,386,903 A * 2/1995 Rothschild et al. ..... 232/15
5,531,640 A * 7/1996 Inoue ..... 453/17
5,688,165 A * 11/1997 Levasseur ..... 453/17
5,881,782 A * 3/1999 Foo et al. ..... 141/351
6,066,038 A * 5/2000 Sciortino et al. ..... 453/17

FOREIGN PATENT DOCUMENTS

| | | |
|---|---|---|
| EP | 0168591 | 1/1986 |
| GB | 256276 | 9/1926 |
| WO | 9848385 | 10/1998 |

* cited by examiner

*Primary Examiner*—Lynne H. Browne
*Assistant Examiner*—William L. Miller
(74) *Attorney, Agent, or Firm*—Francis L. Conte

(57) ABSTRACT

A coin container (12) for a coin-dispensing apparatus (10) comprises a portable enclosure (22) for enclosing a plurality of randomly-arranged loose coins. The enclosure includes a closeable coin input opening and a closeable coin output opening. The enclosure (22) is adapted to be releasably engaged with a coin-dispensing apparatus (10) with the coin output opening in communication with a coin input of the coin-dispensing apparatus.

17 Claims, 4 Drawing Sheets

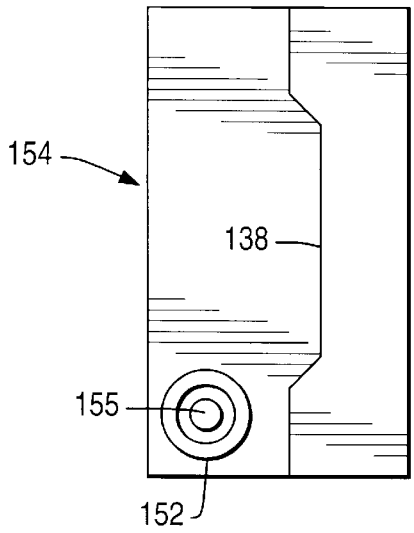
FIG. 3A
FIG. 3B
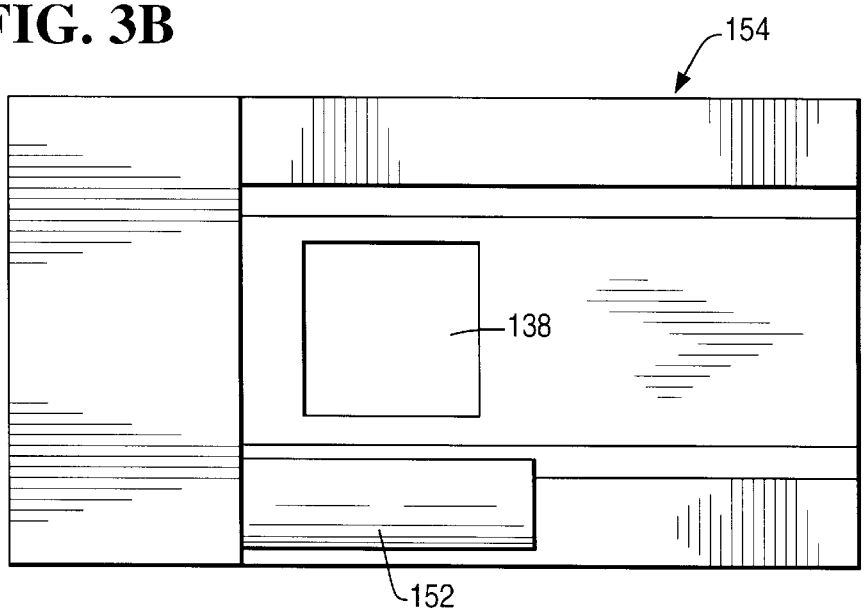
FIG. 3C
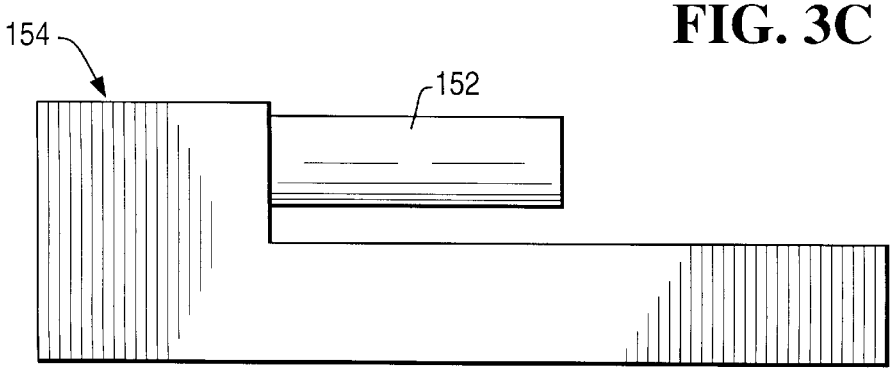

COIN DISPENSER

BACKGROUND OF THE INVENTION

This invention relates to coin dispensers, and to coin containers for use in such dispensers. In particular, the invention relates to coin containers for storing loose, randomly-arranged coins.

In various forms of self-service machines or terminals (SSTs), such as ticket vending machines and in certain forms of automated teller machines (ATMs), there is a requirement to store coins to be dispensed to allow, for example, a user to purchase a travel ticket from a vending machine using a bank note of higher value than the ticket, or to use an ATM to withdraw cash from a bank account, and the cash to be dispensed as coins. Also, there is increasing usage of self-service financial services centers (FSCs), which offer basic "banking" and other financial services, such as printing of money orders, on a self-service basis. FSCs are primarily intended for those members of the public who do not have ready access to conventional banking services and who may not have a bank account. Typically, FSCs are provided in readily accessible locations such as "24 hour" convenience stores. In a typical FSC transaction, a certified pay cheque will be deposited and cash or a money order dispensed. The FSC operator may charge a commission for processing the cheque, such that the FSC will often be required to dispense a sum of money including relatively small currency units; accordingly, the FSC must have the capability to dispense a range of coins.

At present, loose coins (that is, coins not packaged in rolls) are stored within FSCs in large capacity open-topped hoppers of transparent plastics material. The width of the hoppers is very much greater than the diameter of the coins. Typically, loose coins are poured into the hoppers, which results in the coins being randomly-arranged (that is, not in a single neat stack) in the hoppers.

The hoppers supply coin dispensers under the control of a central processor. The hoppers are replenished on site, typically by operators who are employees of security companies contracted to replenish the FSCs with bank notes, coins, and other valuable media, for example blank money orders, and also to remove deposited items from the FSCs. The operators are required to open the FSC to gain access to the hoppers, and then pour coins into the hoppers from open coin bags. This operation is time consuming, such that the FSC is not available to customers for an extended period, and limits the number of FSCs that a team of operators may replenish in a given period, resulting in relatively high running costs. Further, in the majority of locations the FSC will be positioned in a store aisle or the like, and while the FSC is being replenished there may be considerable inconvenience to customers and staff, and loss of display area to the store operator. It will also be evident to anyone within the store that a large number of coins are being handled; coin bags may have to be left lying on the store floor as the operator opens the FSC and gains access to the coin hoppers, and it is not uncommon for coins to spill into the machine interior and onto the floor of a store during a replenishment operation. Even though the sums of money involved are likely to be relatively modest when compared to the value of banknotes held in the machine, the visibility of the coins, either within the coin bags, hoppers, or spilled around the FSC, may present a temptation to an opportunist thief. Also, this method of replenishing machines does not permit for proper auditing of the coins remaining in a hopper prior to refilling, such that machine faults, thefts or other sources of discrepancies may go undetected for a considerable time.

SUMMARY OF THE INVENTION

It is among the objectives of embodiments of the present invention to obviate or mitigate these disadvantages or other disadvantages of the prior art.

According to the present invention there is provided a coin container for engaging with a coin-dispensing apparatus, the container comprising a portable enclosure for enclosing a plurality of randomly-arranged loose coins, the enclosure including a closeable coin input opening for receiving coins and a closeable coin output opening for presenting individual coins, the enclosure being releasably engageable with a coin-dispensing apparatus with the coin output opening in communication with a coin input of the coin-dispensing apparatus.

The invention also relates to a coin-dispensing apparatus adapted to engage the coin container, and to a combination of the apparatus and container. The coin-dispensing apparatus will typically form a part of a self-service terminal (SST), such as an automated teller machine (ATM) or a financial services center (FSC).

The container is thus in the form of a cassette, which may be filled with a known number of coins at a secure central location, following which the coin input opening is closed, typically by a removable lid, and the closed container then delivered to a coin-dispensing apparatus at a remote location. On site, an operator simply opens the coin-dispensing apparatus, removes the existing container, and the coins contained therein, and replaces this with the new container. Thus, the operator does not have to handle loose coins, the operation may be carried out quickly and efficiently, and the nature of the operation will not be evident to casual bystanders. As the container removed from the apparatus remains closed throughout the replenishment operation, it may be returned to the central location for inspection and then opened in a secure environment and the remaining coins counted, allowing proper auditing of the coin supply to the dispenser.

Preferably, the coin input opening is closeable by a tamper evident lid, that is if the lid is removed and then replaced, this will be evident on subsequent inspection of the enclosure. The lid may be secured by a padlock, a loop of material held together by a seal or other fastener, an applied seal of a tamper evident paper or plastics material, a frangible fastener, a tamper evident fastener requiring use of a specialized tool for removal, or indeed any means which provides evidence of tampering, whether visual or otherwise. To minimize expense it is preferable that the lid is secured or sealed by a simple mechanical arrangement, although more sophisticated arrangements may be provided if desired. In other embodiments the lid may be alarmed.

Preferably also, the coin output opening is normally closed, and most preferably is opened by engagement of the enclosure with the coin-dispensing apparatus. The coin output opening may be opened on or following registration of the enclosure coin output opening with a coin input opening of the apparatus. Thus, the coin output opening is normally arranged to prevent or hinder unauthorized removal of coins via the opening, and is only opened on engagement with the coin-dispensing apparatus. Typically, the output opening will include a mechanical closure which is moved from the opening on engagement with an appropriate mechanical fixture on the coin-dispensing apparatus when the container is located in the apparatus. Alternatively, the closure may be opened by electrical, magnetic or other means. Most preferably, the output opening closure is tamper evident, that is inspection will reveal if an attempt has been made to open the closure by unconventional means, that is other than by engagement with the apparatus, and preferably also if the container has been engaged with a coin-dispensing apparatus on more than one occasion; this latter arrangement may be a simple "tell-tale", which is marked, moved or broken each time the container is engaged with or removed from an apparatus. Typically, the coin output opening will communicate directly with a coin pick arrangement for feeding coins, one at a time, from the container into the apparatus.

The coin input and output openings are preferably provided separately in the enclosure, but if desired may be combined in a single opening.

Conveniently, the container will include a portion profiled to engage a corresponding profiled portion of the coin-dispensing apparatus, the profiled portions serving to locate the container correctly and securely in the apparatus. The profiles may include means to open the coin output opening.

The enclosure may be of any suitable material, including plastics and metal, and is preferably formed of molded high impact polycarbonate or other moldable material. The material may be opaque, or may be transparent, allowing visual inspection of the coin level within the container.

The enclosure may be provided with a coin low level sensor, to provide an indication when the level of coins in the container falls below a predetermined level.

According to another aspect of the present invention, there is provided a method of replenishing a coin-dispensing apparatus, the method comprising:

providing a coin container comprising an enclosure including a closeable coin input lid and a closeable coin output opening;

filling the container with loose, randomly-arranged coins at a location remote from the coin-dispensing apparatus;

closing the lid;

transporting the closed container to the coin-dispensing apparatus location;

releasably engaging the coin container with the coin-dispensing apparatus; and opening the coin output opening of the enclosure to permit passage of coins into a coin input of the coin-dispensing apparatus.

In one embodiment, the steps of releasably engaging the coin container with the coin-dispensing apparatus and opening the coin output opening of the enclosure to permit passage of coins into a coin input of the coin-dispensing apparatus may be performed in a single step so that the coin output opening is automatically opened on engagement with the coin dispensing apparatus.

BRIEF DESCRIPTION OF THE DRAWINGS

These and other aspects of the present invention will now be described, by way of example, with reference to) the accompanying drawings, in which:

FIGS. 3A to 3C illustrate side, plan and front views of the container-engaging portion of a coin dispensing apparatus for engaging with the coin container of FIG. 2.

DETAILED DESCRIPTION

Figure 1:
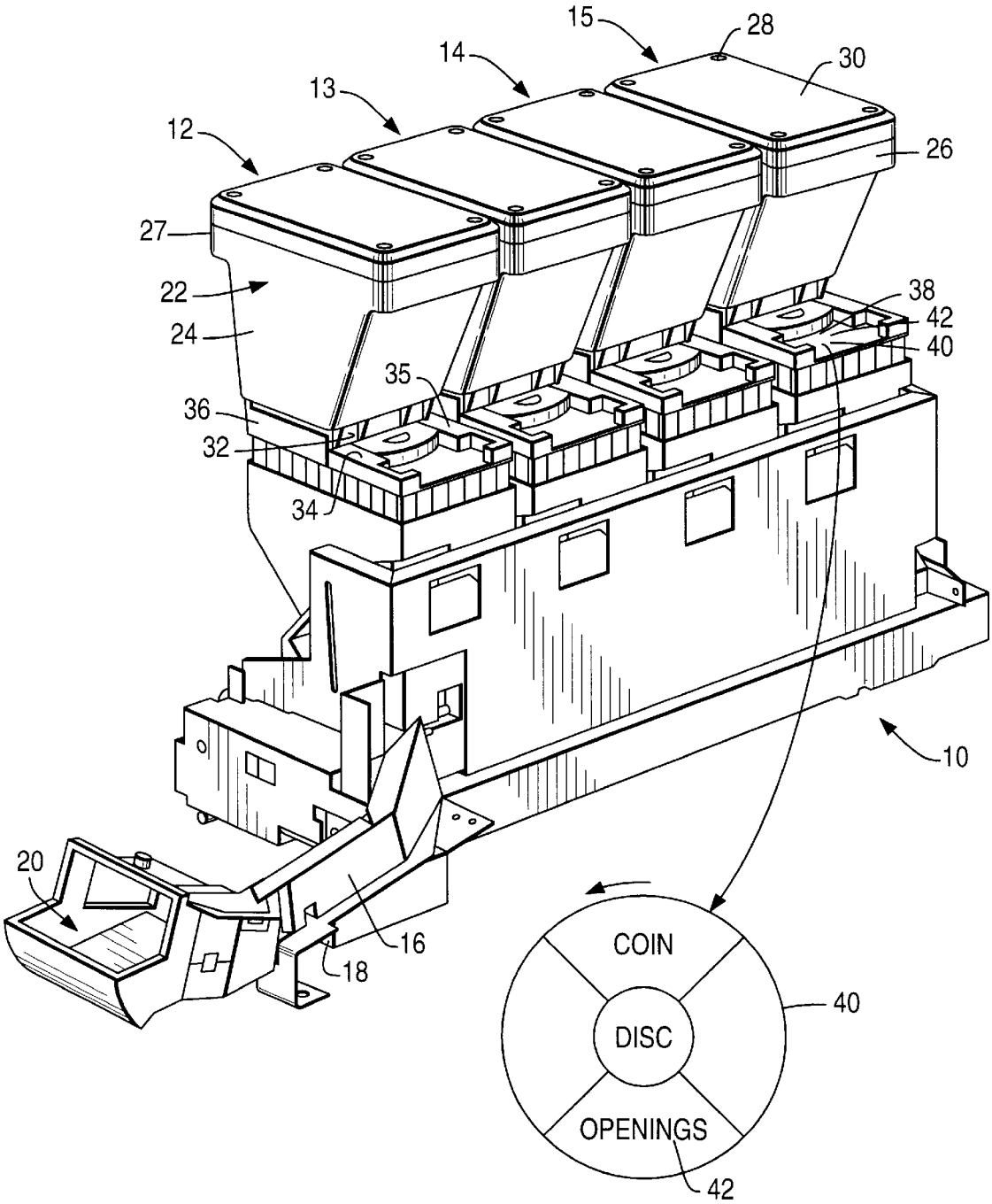
FIG. 1 illustrates four coin containers in accordance with a preferred embodiment of the present invention engaged with a coin dispensing apparatus.

FIG. 1 illustrates a coin dispensing apparatus 10 as may be found in a self-service terminal (SST), such as an automated teller machine (ATM), financial services center (FFC), or vending machine. In this example the apparatus 10 is adapted to be fed by four coin containers 12, 13, 14 and 15 in accordance with a preferred embodiment of the present invention. Under control of the central processing unit of the SST, coins are selectively taken from the containers, 12, 13, 14 and 15 by coin pick arrangements each comprising a rotatable disc provided with a number of openings of corresponding dimensions to the coins to be removed from the individual coin containers, fed past a multi-coin sensor (not shown) within the apparatus 10 (when multiple coins are detected the coins are "dumped") into an exit chute 16 provided with further multi-coin sensor 18, and gravity fed to a coin dispense opening 20 in the facia of the SST.

The coin containers 12, 13, 14 and 15 are substantially similar, such that only one of the containers 12 will be described in detail. The container 12 comprises a molded high impact polycarbonate enclosure 22 having a tapering generally rectangular side wall 24. Flanges 26, 27 extend from the upper front and rear of the enclosure 22 to accommodate four fasteners 28 for securing an enclosure lid 30. The fasteners 28 are tamper evident, in that their fitting and removal requires use of a specialized tool, and other attempts to remove the fasteners 28 will result in visible damage to the fasteners.

The base and the lower side wall of the enclosure 22 are profiled to allow the enclosure 22 to he slid rearwardly on respective rails 34, 35 provided on the upper face of the dispenser 10, and to positively engage with a fitting 36 extending around three sides of the upper face of the dispenser. When properly positioned in the fitting 36, a coin outlet opening defined in the enclosure base 32 is positioned in registration with a respective coin pick arrangement 38 comprising a plastics disc 40 defining a number of openings 42 of corresponding dimensions to the coins held in the container 12; by rotating the disc 40 such that the disc openings 42 pass below the enclosure coin outlet opening, coins are removed from the container 12 one at a time.

The enclosure coin output opening is normally closed by a spring biased closure member, however on the enclosure base 32 engaging the coin dispenser fitting 36, a fixture on the coin dispenser moves the closure member away from the opening, allowing coins to pass into the coin pick apparatus 38.

Figure 4:
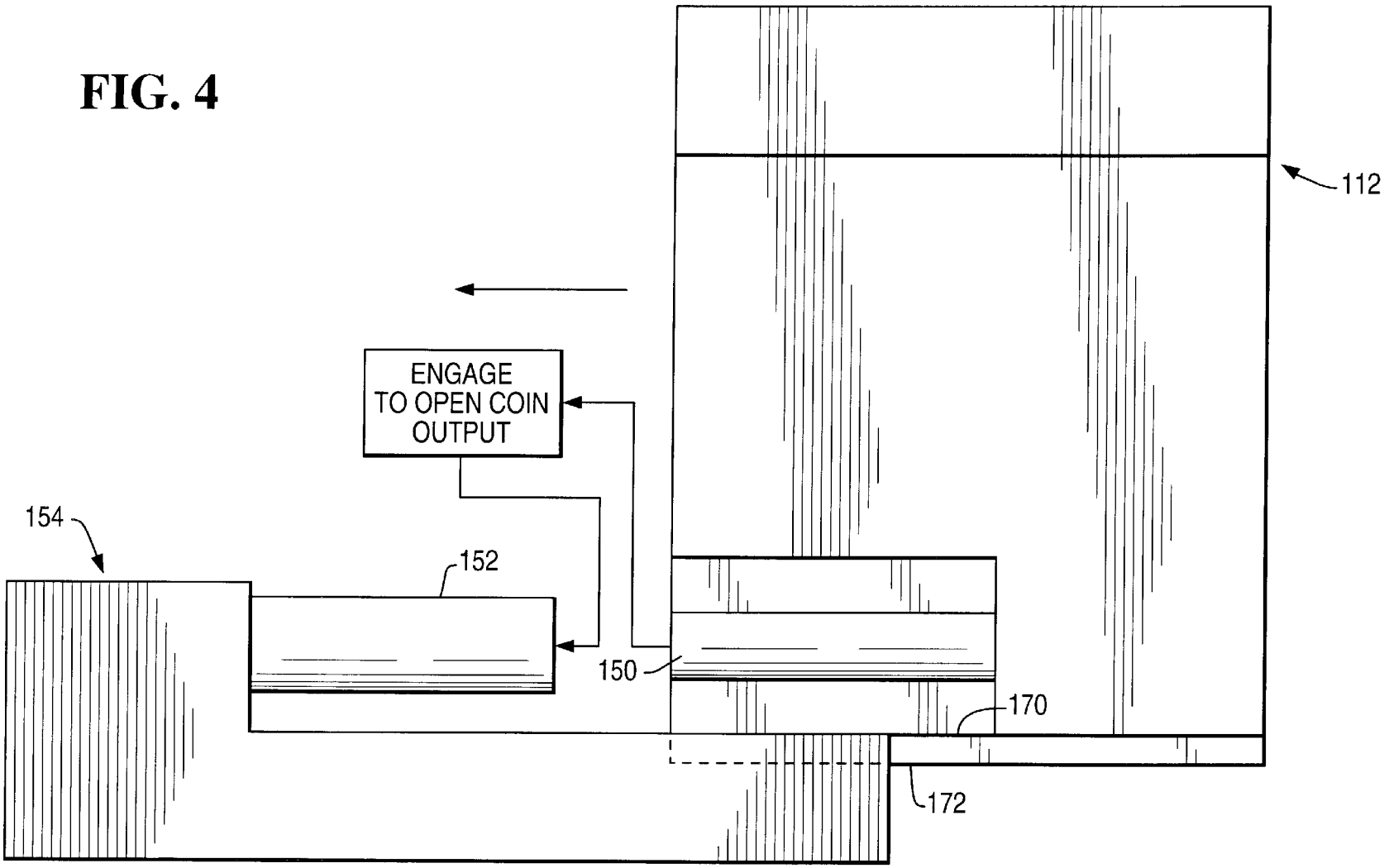
FIG. 4 illustrates the engagement of the coin container of FIG. 2 with the container-engaging portion of the coin dispensing apparatus of FIG. 3.

Referring now to FIGS. 2 to 4, these show schematic views of a coin container according to a further embodiment of the present invention, together with a container-engaging portion of a coin dispensing apparatus and their interaction.

Figure 2A:
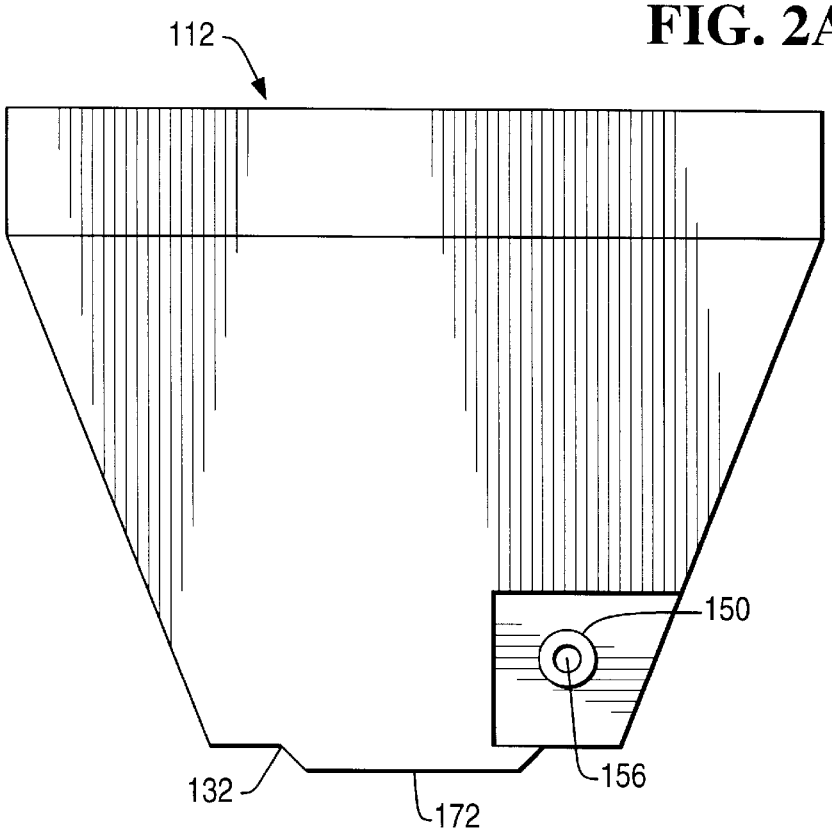
FIGS. 2A and 2B illustrate front and side views of a coin container according to an alternative embodiment of the present invention.
Figure 2B:
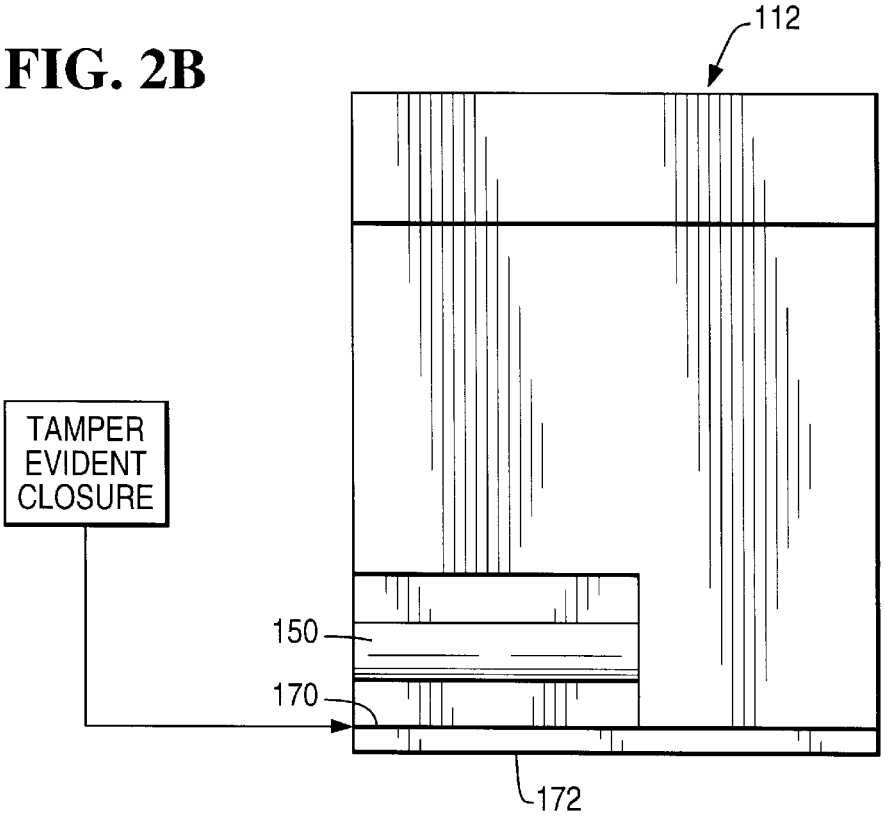

FIGS. 2A and 2B show side and front views of a coin container 112, including a profiled base 132 for engaging with a corresponding portion of the dispenser Located above the base 132 is a receiving member 150, profiled to engage with a corresponding elongate portion 152 on the dispenser 154 (shown in FIGS. 3A to 3C), the portion 152 incorporating a central member 155 which cooperates with an outlet opening mechanism 156 with the member 150. In the base of the container 122 is disposed a closeable coin outlet opening 170 covered by a mechanical closure member 172, actuated by opening mechanism 156.

FIG. 4 shows the container 112 engaging with the dispenser 154. The elongate portion 152 of the dispenser 154 is received within the container member 150, such that the central member 155 operates the outlet opening mechanism 156. When the container 112 is fully engaged with the dispenser 154, the coin outlet opening 170 in the container 112 is opened, and aligned with the coin pick arrangement 138 of the dispenser 154.

When the container 112 is removed from the dispenser 154, the opening mechanism 156 is disengaged from the member 155, and allows the coin outlet opening 170 to close, so preventing loss of coins from the container 112.

It will be apparent to those of skill in the art that the containers 12, 112 described above provide a cassette which may be filled with a predetermined number of coins at a secure central location. Following filling, the lid is secured, and the sealed container is dispatched for delivery to a respective coin dispensing apparatus, such as an ATM, at a remote location. On site, an operator merely has to open the ATM to gain access to the dispenser, remove the existing container, and replace this with the new container. This operation may be carried out quickly and efficiently, and the container removed from the ATM may be returned to the secure central location, still in a sealed condition, for inspection, auditing of the "leftover" coins, and refilling.

It will further be evident to those of skill in the art that the above-described embodiments are merely exemplary of the present invention, and that various modifications and improvements may be made thereto without department from the scope of the invention.

What is claimed is:

1. A coin container for engaging with a coin-dispensing apparatus, the container comprising:

a portable enclosure for enclosing a plurality of randomly-arranged loose coins, the enclosure including (i) first means defining a closeable coin input opening for receiving coins and (ii) second means defining a closeable coin output opening for presenting individual coins, the enclosure being releasably engageable with the coin-dispensing apparatus with the coin output opening in communication with a coin input opening of the coin-dispensing apparatus, and wherein the coin output opening is openable by engagement of the enclosure with the coin-dispensing apparatus; and said first and second means being attached to said enclosure and portable therewith for fully closing said enclosure remote from the coin-dispensing apparatus.

2. A coin container according to claim 1, wherein said first means comprise a lid for the coin input opening of said portable enclosure.

3. A coin container according to claim 1, further comprising tamper evident means for closing the coin input opening of said portable enclosure.

4. A coin container according to claim 1, wherein the coin output opening is normally closed.

5. A coin container according to claim 1, wherein the coin output opening is openable on or following registration of the enclosure coin output opening with said coin input opening of the coin-dispensing apparatus.

6. A coin container according to claim 1, wherein the coin output opening is provided with a tamper evident closure.

7. A coin container according to claim 1, further comprising a profiled portion at said coin outlet opening for engaging a corresponding profiled portion of the coin-dispensing apparatus.

8. A system comprising:

a coin-dispensing apparatus including means defining a coin-input opening;

a portable coin container for enclosing a plurality of randomly arranged loose coins, and including (i) first means defining a closeable coin input opening for receiving coins, (ii) second means defining a closable coin output opening for presenting individual coins and (iii) means for releasably engaging with the coin-dispensing apparatus such that the coin output opening communicates with the coin input opening of the coin-dispensing apparatus; and said first and second means being attached to said container and portable therewith for fully closing said container remote from the coin-dispensing apparatus.

9. A system according to claim 8, wherein the coin container includes a lid for the coin input opening of the container.

10. A system according to claim 8, wherein the coin container includes tamper evident means for closing the coin input opening of the container.

11. A system according to claim 8, wherein the coin output opening is normally closed.

12. A system according to claim 11, wherein said releasably engaging means are effective for opening the coin output opening when the coin container engages the coin-dispensing apparatus.

13. A system according to claim 12, wherein said releasably engaging means are effective for opening the coin output opening when the coin output opening is registered with the coin input opening of the coin-dispensing apparatus.

14. A system according to claim 8, wherein the coin output opening of the coin container is provided with a tamper evident closure.

15. A system according to claim 8, wherein said releasably engaging means comprises (i) the coin-dispensing apparatus including a profiled portion at said coin output opening and (ii) the coin container including a profiled portion for engaging the profiled portion of the coin-dispensing apparatus.

16. A method of replenishing a coin-dispensing apparatus, the method comprising:

providing a coin container comprising an enclosure including a coin input opening having a closeable lid and a coin output opening having a closeable closure member;

filling the container with randomly-arranged, loose coins at a location remote from the coin-dispensing apparatus;

closing the lid;

transporting the closed container to the coin dispensing apparatus location;

releasably engaging the coin container with the coin-dispensing apparatus; and opening the coin output opening of the enclosure to permit passage of coins into a coin input opening of the coin-dispensing apparatus.

17. A method of replenishing a coin-dispensing apparatus having a coin input opening, the method comprising:

filling a coin container through a coin input opening of the coin container with randomly-arranged, loose coins at a location remote from the coin-dispensing apparatus;

closing the coin input opening of the coin container with a closeable lid after the coin container has been filled with randomly-arranged, loose coins;

transporting the closed coin container to the coin-dispensing apparatus location;

releasably engaging the coin container with the coin-dispensing apparatus; and opening a coin output opening of the coin container to allow passage of coins into the coin input opening of the coin-dispensing apparatus to replenish the coin-dispensing apparatus.

* * * * *